US011090782B2

(12) United States Patent
Chiang

(10) Patent No.: US 11,090,782 B2
(45) Date of Patent: Aug. 17, 2021

(54) SOCKET AND METHOD OF USING THE SAME

(71) Applicant: SHIN YING ENTPR CO., LTD., Taichung (TW)

(72) Inventor: Wen-Hung Chiang, Taichung (TW)

(73) Assignee: Shin Ying Entpr Co., Ltd., Taichung (TW)

( * ) Notice: Subject to any disclaimer, the term of this patent is extended or adjusted under 35 U.S.C. 154(b) by 363 days.

(21) Appl. No.: 16/351,998

(22) Filed: Mar. 13, 2019

(65) Prior Publication Data

US 2020/0290179 A1 Sep. 17, 2020

(51) Int. Cl.

*B25B 13/10* (2006.01)
*B25B 13/28* (2006.01)
*B25B 13/06* (2006.01)

(52) U.S. Cl.

CPC ..... *B25B 13/102* (2013.01); *B25B 13/06* (2013.01); *B25B 13/28* (2013.01)

(58) Field of Classification Search

CPC ..... B25B 13/102; B25B 13/06; B25B 13/56
See application file for complete search history.

(56) References Cited

U.S. PATENT DOCUMENTS 1,471,451 A * 10/1923 Crimp ..... B25B 13/102 81/185
1,997,948 A * 4/1935 Pearson ..... B25B 13/102 81/185
2,938,417 A * 5/1960 Haber ..... B25B 13/102 81/185
3,233,482 A * 2/1966 Jaehne ..... B25B 13/102 81/185
3,298,261 A * 1/1967 Lynn ..... B25B 13/102 81/185
4,417,488 A * 11/1983 Gentry ..... B25B 13/06 81/124.4
5,157,995 A 10/1992 Nogues
6,467,379 B1 * 10/2002 Wizman ..... B25B 13/102 81/124.5
7,252,022 B1 * 8/2007 Losee ..... B25B 13/102 81/124.5
2012/0137837 A1 * 6/2012 Souma ..... B25B 13/102 81/124.3

FOREIGN PATENT DOCUMENTS

TW M348666 U 1/2009
TW I576208 B 4/2017

* cited by examiner

*Primary Examiner* — David B. Thomas
(74) *Attorney, Agent, or Firm* — Muncy, Geissler, Olds & Lowe, P.C.

(57) ABSTRACT

A socket is provided, including a first member, a second member and a third member. The second member is movably inserted within the first member. The third member is movably sleeved with the first member.

10 Claims, 6 Drawing Sheets

SOCKET AND METHOD OF USING THE SAME

BACKGROUND OF THE INVENTION

Field of the Invention

The present invention relates to a socket and a method of using the same.

Description of the Prior Art

A socket is usually used to drive a fastener such as screw, bolt or nut. An assembling portion of the socket is of a fixed shape and size so that the assembling portion can only be assembled with the fastener corresponding to its shape and size. Therefore, a plurality of sockets with different sizes and shapes are required for various requirements, which is of high cost and inconvenient for storage and carrying. As a result, a socket having two or more assembling portions of different sizes is developed, such as the socket disclosed in Taiwan Patent Number 1576208 and U.S. Pat. No. 5,157,995.

The socket as described above includes an outer assembling portion and a plurality of assembling portions which are disposed within the outer assembling portion and radially overlapped with one another. The plurality of assembling portions are axially movable relative to the outer assembling portion. In operation, the socket is assembled to a fastener and the assembling portions smaller than the fastener are pressed and retracted relative to the outer assembling portion so that the fastener can be assembled with one of the assembling portions.

However, this type of socket requires a plurality of springs with different size and elastic forces and a plurality of restricting mechanisms to prevent components disposed therein from departing therefrom, which causes that the components have to be coordinated closely with one another and the socket is difficult to be processed and assembled and of high cost.

Another type of socket, as disclosed in Taiwan Patent Number M348666, includes an outer housing and a plurality of sleeve members which are disposed within the outer housing and overlapped with one another for fasteners with various sizes. The plurality of sleeve members respectively have guiding grooves of different lengths disposed therethrough, and a plurality of rods are respectively connected one of the plurality of sleeve members to the outer housing. In operation, a required one of the sleeve member is moved to protrude beyond the outer housing.

However, components of the socket as described above also have to be coordinated closely with one another, which are difficult to be processed, such as forming the guiding grooves, positions of positioning mechanisms, structure of the rod. In operation, the torque generated by rotating the socket is exerted on the rod, which results in deformation of the rod.

The present invention is, therefore, arisen to obviate or at least mitigate the above-mentioned disadvantages.

SUMMARY OF THE INVENTION

The main object of the present invention is to provide a socket which has a simple structure and a small volume for easy operation.

To achieve the above and other objects, the present invention provides a socket, including: a first member, a second member and a third member. The first member includes a connection portion and a first sleeve portion which are opposite to each other, and the first sleeve portion is configured to drive a first object. The second member is inserted within the first member and includes a second sleeve portion configured to drive a second object. The second sleeve portion is received within the first sleeve portion, and the second sleeve portion is movable relative to the first sleeve portion in a direction toward the connection portion so that the first object is drivable by the first sleeve portion. The third member is sleeved with the first member and includes a third sleeve portion. The third sleeve portion is movable relative to the first sleeve portion in a direction away from the connection portion, and part of the third sleeve portion protrudes beyond the first sleeve portion and configured to drive a third object. Inner diametric dimensions of the first sleeve portion, the second sleeve portion and the third sleeve portion are different from one another.

To achieve the above and other objects, the present invention further provides a method of using the socket as described above, including following step of: choosing the first sleeve portion, pressing the second sleeve portion in the direction toward the connection portion so that the second sleeve portion retracts toward the connection portion relative to the first sleeve portion and the first sleeve portion is configured to receive the first object; or choosing the second sleeve portion to receive the second object; or choosing the third sleeve portion, pulling the third sleeve portion in the direction away from the connection portion so that the third sleeve portion protrudes beyond the first sleeve portion to receive the third object.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
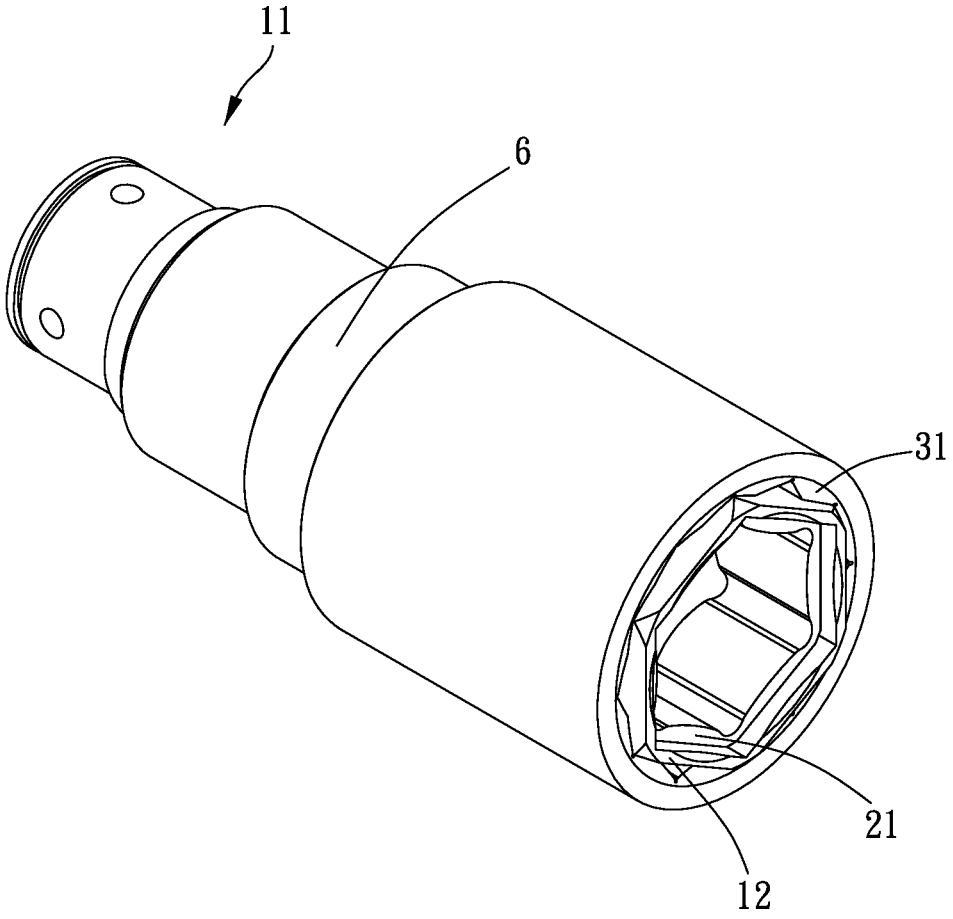
FIG. 1 is a schematic diagram of a preferable embodiment of the present invention when a second sleeve portion is chosen to use.
Figure 2:
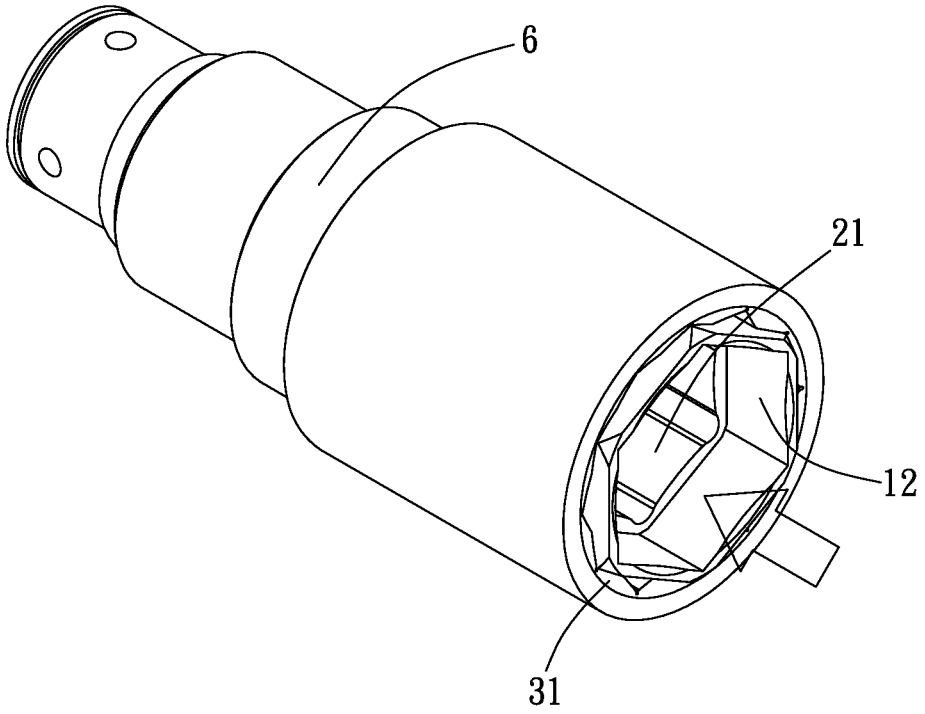
FIG. 2 is a schematic diagram of a preferable embodiment of the present invention when a first sleeve portion is chosen to use.
Figure 3:
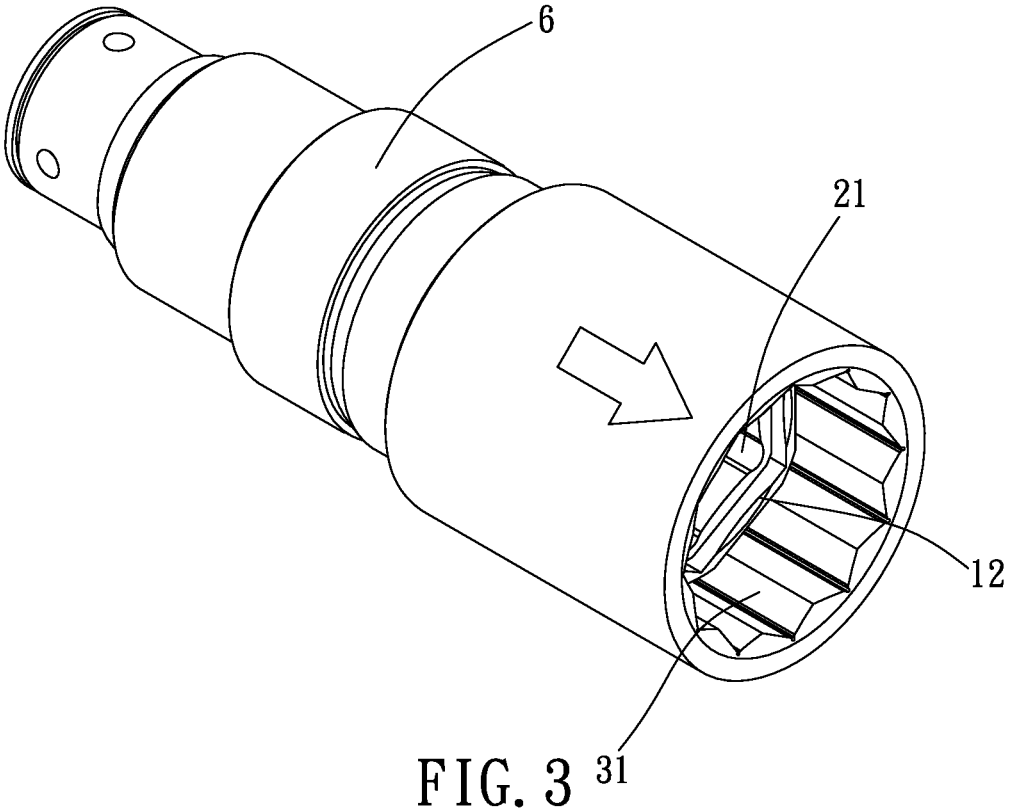
FIG. 3 is a schematic diagram of a preferable embodiment of the present invention when a third sleeve portion is chosen to use.
Figure 4:
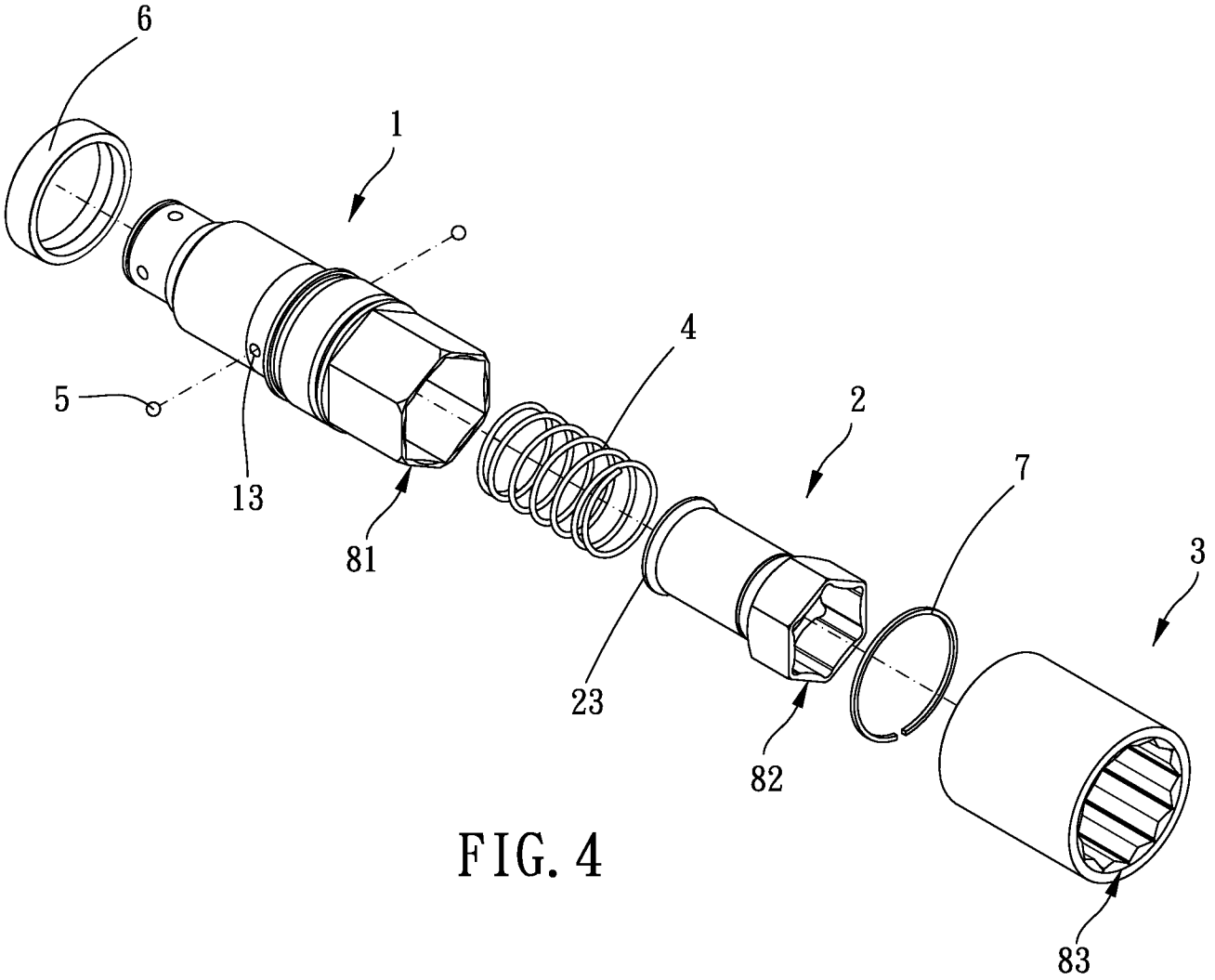
FIG. 4 is a breakdown drawing of a preferable embodiment of the present invention.
Figure 5:
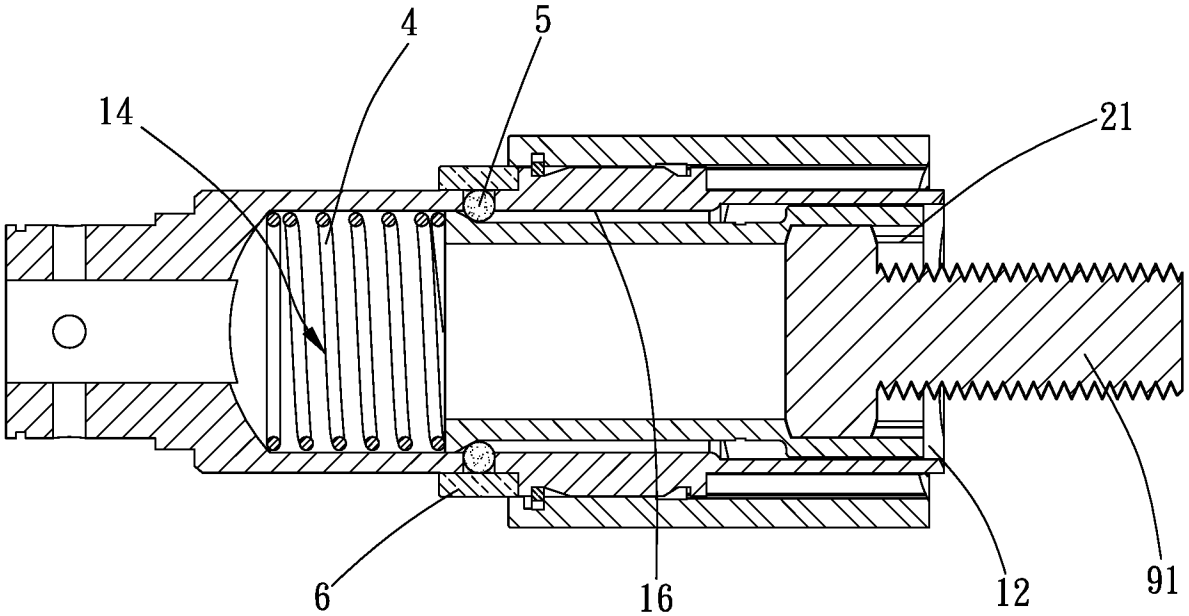
FIG. 5 is a schematic diagram of a preferable embodiment of the present invention when the second sleeve portion is assembled to a second object.
Figure 6:
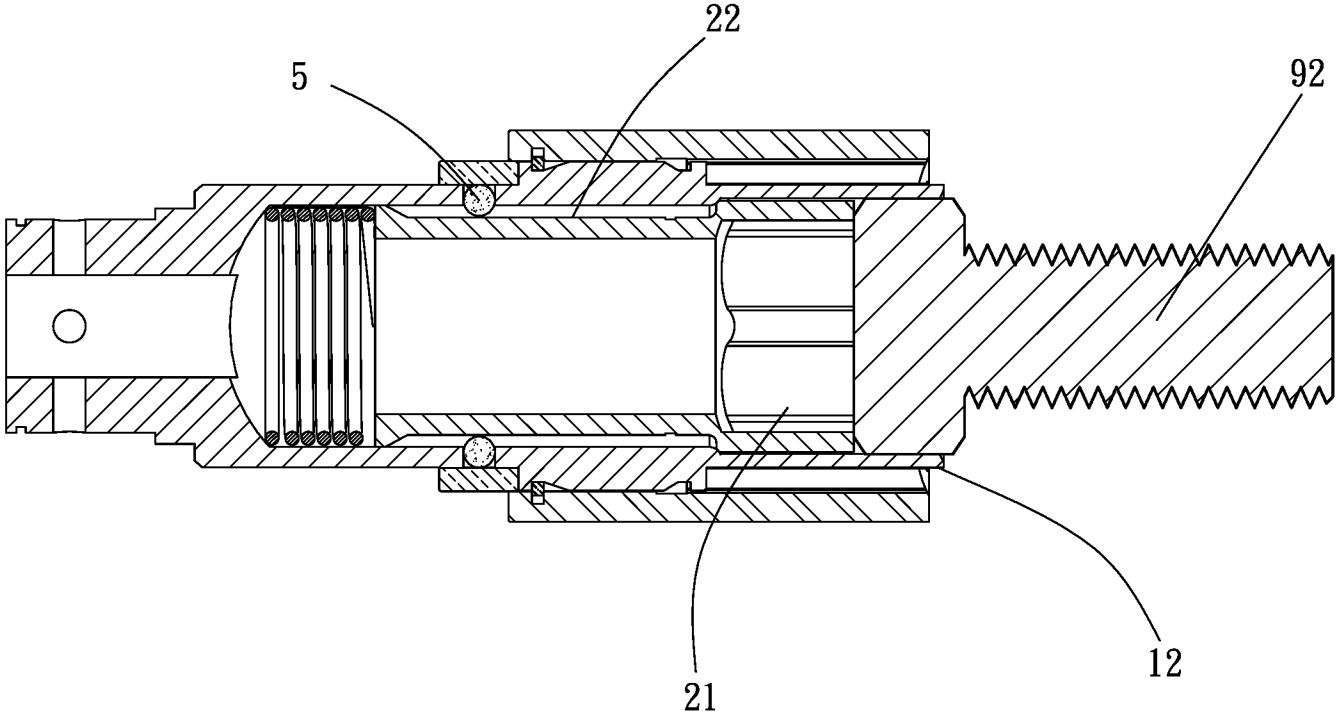
FIG. 6 is a schematic diagram of a preferable embodiment of the present invention when the first sleeve portion is assembled to a first object.
Figure 7:
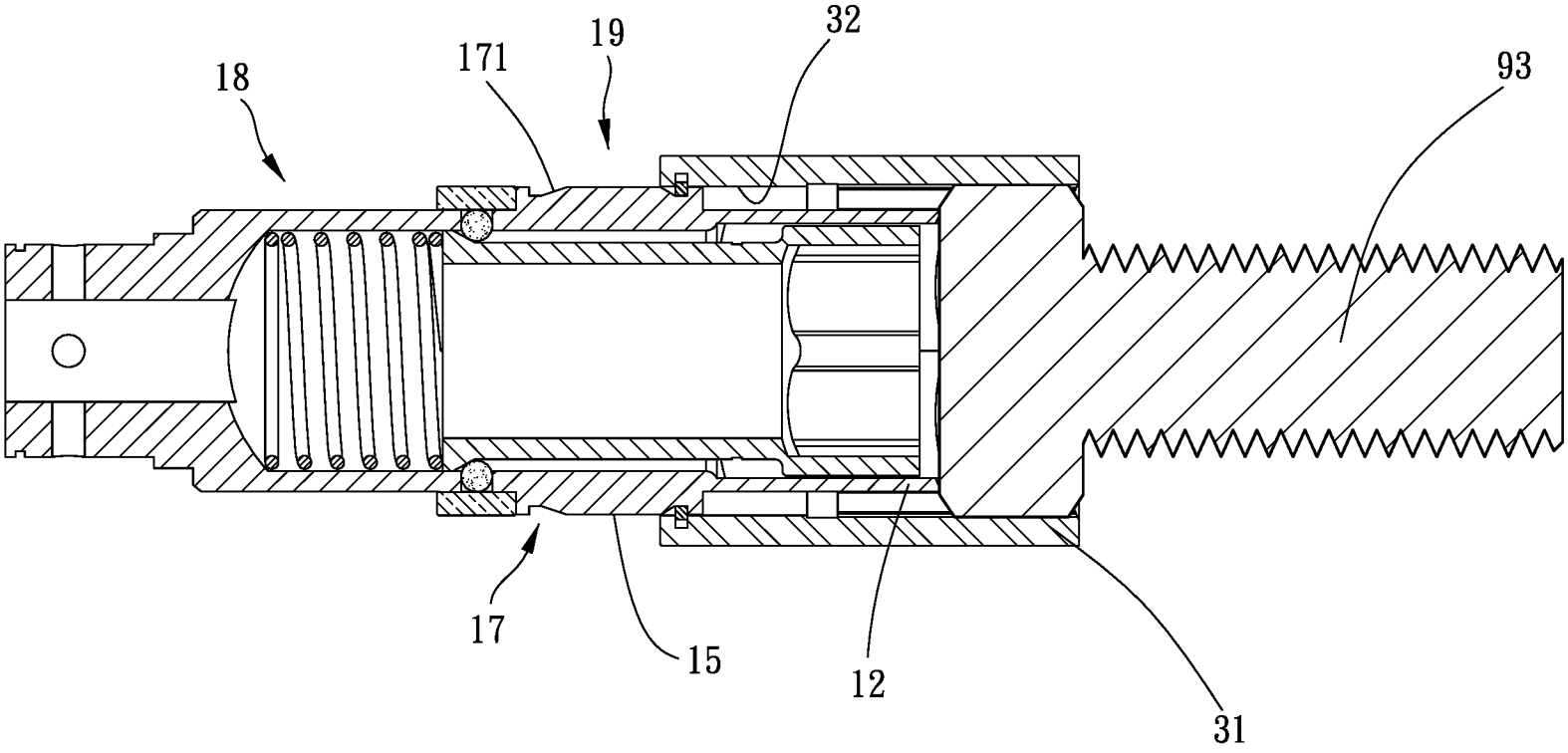
FIG. 7 is a schematic diagram of a preferable embodiment of the present invention when the third sleeve portion is assembled to a third object.

Please refer to FIGS. 1 to 7 for a preferable embodiment of the present invention. A socket of the present invention includes a first member 1, a second member 2 and a third member 3.

The first member 1 includes a connection portion 11 and a first sleeve portion 12 which are opposite to each other, and the first sleeve portion 12 is configured to drive a first object 91. The second member 2 is inserted within the first member 1 and includes a second sleeve portion 21 configured to drive a second object 92. The second sleeve portion 21 is received within the first sleeve portion 12, and the second sleeve portion 21 is movable relative to the first sleeve portion 12 in a direction toward the connection portion 11 so that the first object 91 is drivable by the first sleeve portion 12.

The third member 3 is sleeved with the first member 1 and includes a third sleeve portion 31. The third sleeve portion 31 is movable relative to the first sleeve portion 12 in a direction away from the connection portion 11, and part of the third sleeve portion 31 protrudes beyond the first sleeve portion 12 and is configured to drive a third object 93. Inner diametric dimensions of the first sleeve portion 12, the second sleeve portion 21 and the third sleeve portion 31 are different from one another.

The second member 2 is inserted within the first member 1 and the third member 3 is sleeved with the first member 1 so that the second sleeve portion 21 and the third sleeve portion 31 are individually movable relative to the first sleeve portion 12 and non-interfered with each other. Operators can rapidly choose a required size of sleeve portion and intuitively use the socket.

A method of using the socket as described above is further provided, including following step of: choosing the first sleeve portion 12, pressing the second sleeve portion 21 in the direction toward the connection portion 11 so that the second sleeve portion 21 retracts toward the connection portion 11 relative to the first sleeve portion 12 and the first sleeve portion 12 is configured to receive the first object 91; or choosing the second sleeve portion 21 to receive the second object 92; or choosing the third sleeve portion 31, pulling the third sleeve portion 31 in the direction away from the connection portion 11 so that the third sleeve portion 31 protrudes beyond the first sleeve portion 12 to receive the third object 93.

The second sleeve portion 21 and the third sleeve portion 31 are separated by the first sleeve portion 12 so as to be moved individually and non-interfered with each other. Preferably, the second sleeve portion 21 non-protrudes beyond the first sleeve portion 12 so that the first sleeve portion 12 can avoid external objects biasing against the second sleeve portion 21.

Specifically, the first sleeve portion 12 defines a first polygonal hole 81, the second sleeve portion 21 defines a second polygonal hole 82, and the third sleeve portion 31 defines a third polygonal hole 83. The first polygonal hole 81, the second polygonal hole 82 and the third polygonal hole 83 are respectively selected from one of a hexagonal hole and a dodecagonal hole so that they have various combinations for various requirements. In this embodiment, shapes of the second polygonal hole 82, the first polygonal hole 81 and the third polygonal hole 83 are hexagonal, hexagonal and dodecagonal in sequence but not be limited thereto. In other embodiments, the shapes of the second polygonal hole, the first polygonal hole and the third polygonal hole may respectively be: hexagonal, hexagonal, hexagonal; hexagonal, hexagonal, dodecagonal; hexagonal, dodecagonal, hexagonal; dodecagonal, hexagonal, hexagonal; hexagonal, dodecagonal, dodecagonal; dodecagonal, hexagonal, dodecagonal; dodecagonal, dodecagonal, hexagonal; dodecagonal, dodecagonal, dodecagonal.

In this embodiment, the first member 1 further includes a receiving space 14 and a first inner wall 16 defining the receiving space 14. The second member 2 is movably inserted within the receiving space 14. An elastic member 4 is disposed in the receiving space 14 and two ends of the elastic member 4 are respectively connected with the first inner wall 16 and the second member 2 so that the second member 2 is biased in the direction away from the connection portion 11. When the first object 91 is disassembled with the first sleeve portion 12, the elastic member 4 biases the second member 2 to its original position. When the first sleeve portion 12 is assembled with the first object 91, the elastic member 4 elastically biases against the second sleeve portion 21 to abut against the first object 91, which increases a contact area between the socket and the first object 91 and stably drives the first object 91, especially when the socket is upwardly assembled with the first object 91.

Specifically, a second outer wall 22 of the second member 2 has a blocking portion 23 protruding therefrom, and the blocking portion 23 and the second sleeve portion 21 are spaced apart from each other. At least one restricting member 5 is positioned on the first member 1 and protrudes beyond the first inner wall 16, and the at least one restricting member 5 is slidably movable between the blocking portion 23 and the second sleeve portion 21. The blocking portion 23 is interferable with the at least one restricting member 5 in a moving direction of the second member 2, which prevents the second member 2 from departing from the first member 1 so that the second member 2 is movable relative to the first member 1 in a range.

Furthermore, the first member 1 has at least one through hole 13, and a number of the at least one through hole 13 is equal to a number of the at least one restricting member 5 (the number is two in this embodiment). The at least one restricting member 5 is penetrated through the at least one through hole 13 and protrudes beyond the first inner wall 16. A sleeve ring 6 is positionably sleeved to the first member 1, and the at least one restricting member 5 is biased by the sleeve ring 6 to protrude beyond the first inner wall 16.

In this embodiment, the third member 3 is movably sleeved with the first member 1, and the first sleeve portion 12 is abuttable against the third object 93 when the third sleeve portion 31 is assembled with the third object 93 for stable supporting.

Specifically, a first outer wall 15 of the first member 1 has two annular grooves 17 disposed thereon, and the two annular grooves 17 are spaced apart from each other in a longitudinal direction of the first member 13. A retainer 7 is positioned on the third member 3 and protrudes beyond a third inner wall 32 of the third member 3, and the retainer 7 is slidable between the two annular grooves 17 and engageable within one of the two annular grooves 17 so as to prevent the third member 3 from departing from the first member 1 and position the third member 3. Moreover, the two annular grooves 17 include respective inclined guiding surfaces 171 at respective sides of the two annular grooves 17 adjacent to each other. Respective extending directions of the respective inclined guiding surfaces 171 are tilted toward each other, and the respective inclined guiding surfaces 171 are configured to guide the retainer 7.

The blocking portion 23 of the second outer wall 22 and the at least one restricting member 5 penetrating through the first member 1 are interferable with each other so that the second member 2 can be restrictedly movable relative to the first member 1. The retainer 7 embedded within the third inner wall 32 is engageable within one of the two annular grooves 17 disposed on the first outer wall 15 so that the third member 3 can be restrictedly movable relative to the first member 1. The first outer wall 15 and the second outer wall 22 are easy to be processed and it is only has to form a groove on the third inner wall 32 for receiving the retainer 7 so that the socket has the advantages of easy manufacturing and rapid assembling.

A portion of the first member 1 on which the two annular grooves 17 are disposed is defined as a second section 19, and a first section 18 is connected between the second section 19 and the connection portion 11. The first sleeve portion 12 is connected to an end of the second section 19 opposite to the first section 18. Among the first section 18, the second section 19 and the first sleeve portion 12, the second section 19 is the thickest, the first sleeve portion 12 is the thinnest, and an outer diameter of the second section 19 is the largest. The at least one through hole 13 is disposed on the first section 18. The sleeve ring 6 is flush with the second section 19 and laterally abutted against the second section 19 when the sleeve ring 6 is sleeved to the first section 18.

Among the first sleeve portion 12, the second sleeve portion 21 and the third sleeve portion 31, a wall of the third sleeve portion 31 is the thickest, and a wall of the first sleeve portion 12 is the thinnest. Respective thicknesses of walls of the first sleeve portion 12, the second sleeve portion 21 and the third sleeve portion 31 are larger than or equal to 1.5 mm so as to provide high structural strength. In the longitudinal direction of the first member 1, a length of the first sleeve portion 12 and a length of the third sleeve portion 31 are preferably the same so that the first member 1 is abuttable against the third object 93. A ratio of a length of the second sleeve portion 21 to the length of the first sleeve portion 12 is preferably between 0.5 and 0.7 so that the second member 2 is abuttable against the first object 91.

In summary, the socket provides three sleeve portions with different sizes for operators to choose, wherein the second sleeve portion can be directly used, the first sleeve portion can be used by retracting the second member relative to the first member, and the third sleeve portion can be used by protuding the third member beyond the first member. The second member and the third member are movable in opposite directions so that the socket has a simple structure for rapid assembling and a small volume for being portable.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A socket, including:

a first member, including a connection portion and a first sleeve portion which are opposite to each other, the first sleeve portion being configured to drive a first object;

a second member, being inserted within the first member, including a second sleeve portion configured to drive a second object, the second sleeve portion being received within the first sleeve portion, the second sleeve portion being movable relative to the first sleeve portion in a direction toward the connection portion so that the first object is drivable by the first sleeve portion;

a third member, being sleeved with the first member, including a third sleeve portion, the third sleeve portion being movable relative to the first sleeve portion in a direction away from the connection portion, and part of the third sleeve portion protruding beyond the first sleeve portion and configured to drive a third object;

wherein inner diametric dimensions of the first sleeve portion, the second sleeve portion and the third sleeve portion are different from one another.

2. The socket of claim 1, wherein the first member further includes a receiving space and a first inner wall defining the receiving space, the second member is movably inserted within the receiving space, an elastic member is disposed in the receiving space and two ends of the elastic member are respectively connected with the first inner wall and the second member so that the second member is biased in the direction away from the connection portion.

3. The socket of claim 2, wherein a second outer wall of the second member has a blocking portion protruding therefrom, the blocking portion and the second sleeve portion are spaced apart from each other, at least one restricting member is positioned on the first member and protrudes beyond the first inner wall, and the at least one restricting member is slidably movable between the blocking portion and the second sleeve portion; the blocking portion is interferable with the at least one restricting member in a moving direction of the second member.

4. The socket of claim 3, wherein the first member has at least one through hole, a number of the at least one through hole is equal to a number of the at least one restricting member, and the at least one restricting member is penetrated through the at least one through hole and protrudes beyond the first inner wall.

5. The socket of claim 4, wherein a sleeve ring is positionably sleeved to the first member, and the at least one restricting member is biased by the sleeve ring to protrude beyond the first inner wall.

6. The socket of claim 5, wherein the third member is movably sleeved with the first member, a first outer wall of the first member has two annular grooves disposed thereon, the two annular grooves are spaced apart from each other in a longitudinal direction of the first member, a retainer is positioned on the third member and protrudes beyond a third inner wall of the third member, and the retainer is slidable between the two annular grooves and engageable within one of the two annular grooves; the two annular grooves include respective inclined guiding surfaces at respective sides of the two annular grooves adjacent to each other, respective extending directions of the respective inclined guiding surfaces are tilted toward each other, and the respective inclined guiding surfaces are configured to guide the retainer; a portion of the first member on which the two annular grooves are disposed is defined as a second section, a first section is connected between the second section and the connection portion, the first sleeve portion is connected to an end of the second section opposite to the first section; among the first section, the second section and the first sleeve portion, the second section is the thickest, the first sleeve portion is the thinnest, and an outer diameter of the second section is the largest; the at least one through hole is disposed on the first section, the sleeve ring is flush with the second section and laterally abutted against the second section when the sleeve ring is sleeved to the first section; among the first sleeve portion, the second sleeve portion and the third sleeve portion, a wall of the third sleeve portion is the thickest, a wall of the first sleeve portion is the thinnest; respective thicknesses of walls of the first sleeve portion, the second sleeve portion and the third sleeve portion are larger than or equal to 1.5 mm; in the longitudinal direction of the first member, a length of the first sleeve portion and a length of the third sleeve portion are the same, a ratio of a length of the second sleeve portion to the length of the first sleeve portion is between 0.5 and 0.7; the second sleeve portion is nonprotrusive beyond the first sleeve portion.

7. The socket of claim 1, wherein the third member is movably sleeved with the first member, a first outer wall of the first member has two annular grooves disposed thereon, the two annular grooves are spaced apart from each other in a longitudinal direction of the first member, a retainer is positioned on the third member and protrudes beyond a third inner wall of the third member, and the retainer is slidable between the two annular grooves and engageable within one of the two annular grooves.

8. The socket of claim 7, wherein the two annular grooves include respective inclined guiding surfaces at respective sides of the two annular grooves adjacent to each other, respective extending directions of the respective inclined guiding surfaces are tilted toward each other, and the respective inclined guiding surfaces are configured to guide the retainer.

9. The socket of claim 1, wherein the first sleeve portion defines a first polygonal hole, the second sleeve portion defines a second polygonal hole, the third sleeve portion defines a third polygonal hole; the first polygonal hole, the second polygonal hole and the third polygonal hole are respectively selected from one of a hexagonal hole and a dodecagonal hole.

10. A method of using the socket of claim 1, including following step of:

choosing the first sleeve portion, pressing the second sleeve portion in the direction toward the connection portion so that the second sleeve portion retracts toward the connection portion relative to the first sleeve portion and the first sleeve portion is configured to receive the first object; or choosing the second sleeve portion to receive the second object; or choosing the third sleeve portion, pulling the third sleeve portion in the direction away from the connection portion so that the third sleeve portion protrudes beyond the first sleeve portion to receive the third object.

* * * * *